US005078521A

United States Patent [19]

Motta et al.

[11] Patent Number: 5,078,521

[45] Date of Patent: Jan. 7, 1992

[54] HIGH-SPEED OR HIGH-DEFINITION DOT MATRIX PRINTING HEAD

[75] Inventors: Carlo Motta, Borgofranco; Contardo Adamoli, Castellamonte, both of Italy

[73] Assignee: Microlys S.p.A., Ivrea, Italy

[21] Appl. No.: 389,126

[22] Filed: Aug. 3, 1989

[30] Foreign Application Priority Data

Aug. 5, 1988 [IT] Italy ..... 67751 A/88

[51] Int. Cl.[5] ..... B41J 3/04

[52] U.S. Cl. ..... 400/124; 101/93.05

[58] Field of Search ..... 400/124 VI, 124 WD; 101/93.05

[56] References Cited

U.S. PATENT DOCUMENTS

| | | | |
|---|---|---|---|
| 4,010,835 | 3/1977 | Martin et al. | 400/124 VI |
| 4,031,992 | 6/1977 | Murat et al. | 400/124 VI |
| 4,059,182 | 11/1977 | Gustafsson et al. | 400/124 VI |
| 4,143,979 | 3/1979 | Boyd | 400/124 WD |
| 4,794,407 | 12/1988 | Vonasek | 400/124 VI |
| 4,812,061 | 3/1989 | Tsuyuki | 400/124 |

FOREIGN PATENT DOCUMENTS

| | | | |
|---|---|---|---|
| 31421 | 7/1981 | European Pat. Off. | 400/124 VI |
| 59-55761 | 3/1984 | Japan | 400/124 VI |
| 198167 | 11/1984 | Japan | 400/124 VI |

OTHER PUBLICATIONS

IBM Tech. Disc. Bulletin, vol. 24, No. 10, 3/82 Rotatable Wire Matrix Printhead.

*Primary Examiner*—Edgar S. Burr
*Assistant Examiner*—Ren Yan
*Attorney, Agent, or Firm*—Kinney & Lange

[57] ABSTRACT

A dot matrix printing head on which the tips of the printing pins are supported on a matrix, in turn supported on a body designed to travel in the printing plane, in two side by side, parallel offset rows; mainly characterized by the fact that the matrix is supported in idle manner on the supporting body; the printing head presenting means for selectively turning the matrix into two angular positions, in a first of which, the rows of pins are substantially perpendicular to the printing plane for enabling high-definition printing, and in a second of which, both rows of pins are arranged obliquely in relation to the printing plane, and at such an angle that the tips of the pins in both rows are coplanar, thus enabling high-speed printing. (FIGS. 2 and 4).

5 Claims, 3 Drawing Sheets

HIGH-SPEED OR HIGH-DEFINITION DOT MATRIX PRINTING HEAD

BACKGROUND OF THE INVENTION

The present invention relates to a high-speed or high-definition dot matrix printing head whereby the print pins are guided by the matrix through two parallel, side by side rows of holes located on the matrix and lying in a plane parallel to the printing plane.

Known dot matrix printing heads, particulary 24-pin types, for high-speed, low-definition (draft) printing, or high-definition NLQ (near letter quality) printing at slower yet still considerably fast speed, present a printing pin guide matrix with two rows of holes arranged side by side, so that the tips of the pins striking the ribbon for imprinting an ink dot on the printing paper are arranged in two parallel, side by side rows, usually perpendicular to the operating plane of the printing head, hereinafter referred to as the "printing plane". The print characters are formed by printing a number of dots on the sheet according to predetermined grids (or matrixes), by selectively activating the printing pins, against the action of elastic means and via rocking striker elements controlled by electromagnets, while at the same time shifting the printing head accordingly in the printing plane. According to a first known embodiment, the matrix supporting and guiding the printing pins is formed in two parts designed to slide perpendicular to the printing plane so that, for high-speed, low-definition printing, the pins in both rows (each supported on one of the component parts of the matrix) are arranged side by side in the same plane. For high-definition printing at slower speed, on the other hand, the two parts of the matrix are shifted vertically so as to offset one row of pins in relation to the other and so print characters with partially overlapping dots. In view of the severe operating stress involved, printing heads featuring a two-part matrix of the aforementioned type are of fairly complex, intricate design and, therefore, poorly dependable.

A second known embodiment features a one-piece matrix with offset pin guiding holes, so that the pins are normally arranged in two offset rows, as required for high-definition printing. For high-speed printing, a special mechanism provides for turning the entire printing head through a given angle, so as to set both rows of pins obliquely in relation to the printing plane, with the pins in both rows lying in the same plane. In addition to being equally complex in design and requiring said rotation mechanism, a major drawback of the head according to the above embodiment is that it does not allow for switching from high-speed to high-definition printing and vice versa while it is operating, due to the inertia of the same preventing it from being rotated accurately while moving. Heads of the above type must therefore be set to a given print mode while stationary, and stopped for switching to the other mode.

SUMMARY OF THE INVENTION

The aim of the present invention is to provide a dot matrix printing head on which the pins are supported by the guide matrix in two separate parallel rows, and which is designed to overcome the drawbacks typically associated with known printing heads of the aforementioned types, i.e. which is fairly straight-forward in design, cheap to produce, and provides for switching from high-speed to high-definition printing and vice versa while the head is moving. With this aim in view, according to the present invention, there is provided a dot matrix printing head comprising a supporting body designed to travel in the printing plane; a number of rocking striker elements arranged radially in a ring about the longitudinal axis of symmetry of said supporting body parallel to said printing plane, and each activated selectively by means of a respective electromagnet; and a number of flexible printing pins moved along said axis by guide means, and each having a root end designed to cooperate with a first end of a respective said striker element so as to be selectively shifted, against the action of elastic means, by the rocking action of the same; said guide means supporting the respective tips of said flexible pins, opposite said root ends, in a first and second row parallel to each other; each said row being defined by a series of equally-space coplanar tips, and the tips in said first row presenting the same spacing and being located beside and offset in relation to those of said second row; characterised by the fact that said root ends of said pins are secured integral with said first ends of said striker elements; and by the fact that said guide means are mounted in idle manner on said supporting body so as to turn about said axis; said printing head also comprising means for selectively setting said guide means to two different angular positions, in a first of which said rows are arranged substantially perpendicular to said printing plane, and in a second of which said rows are arranged obliquely in relation to said printing plane, and at such an angle that the tips in said first row are located beside those of said second row and in common planes parallel to the printing plane.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
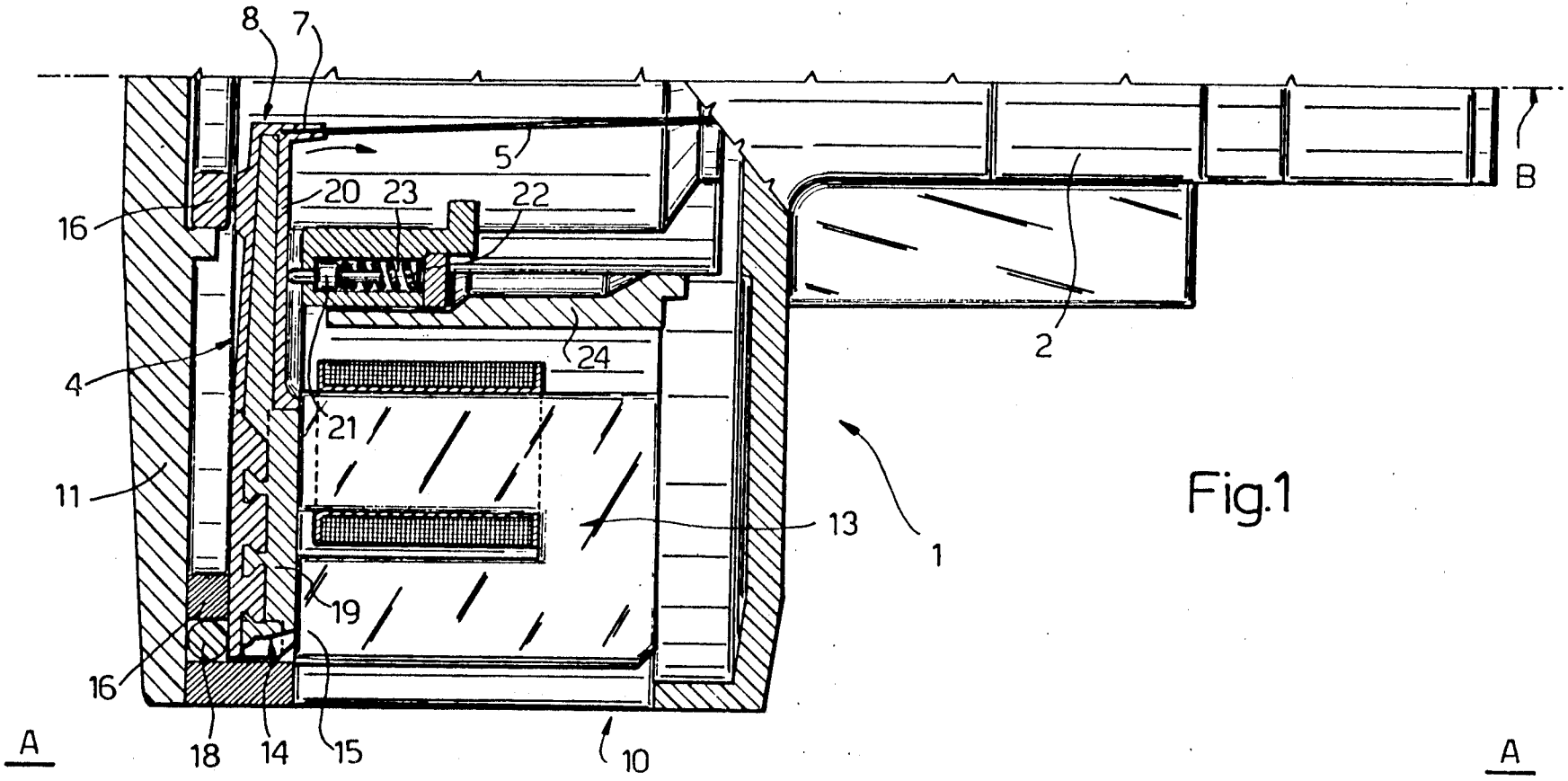
FIG. 1 shows a partially-sectioned part view of a dot matrix printing head in accordance with the teachings of the present invention.
Figure 2:
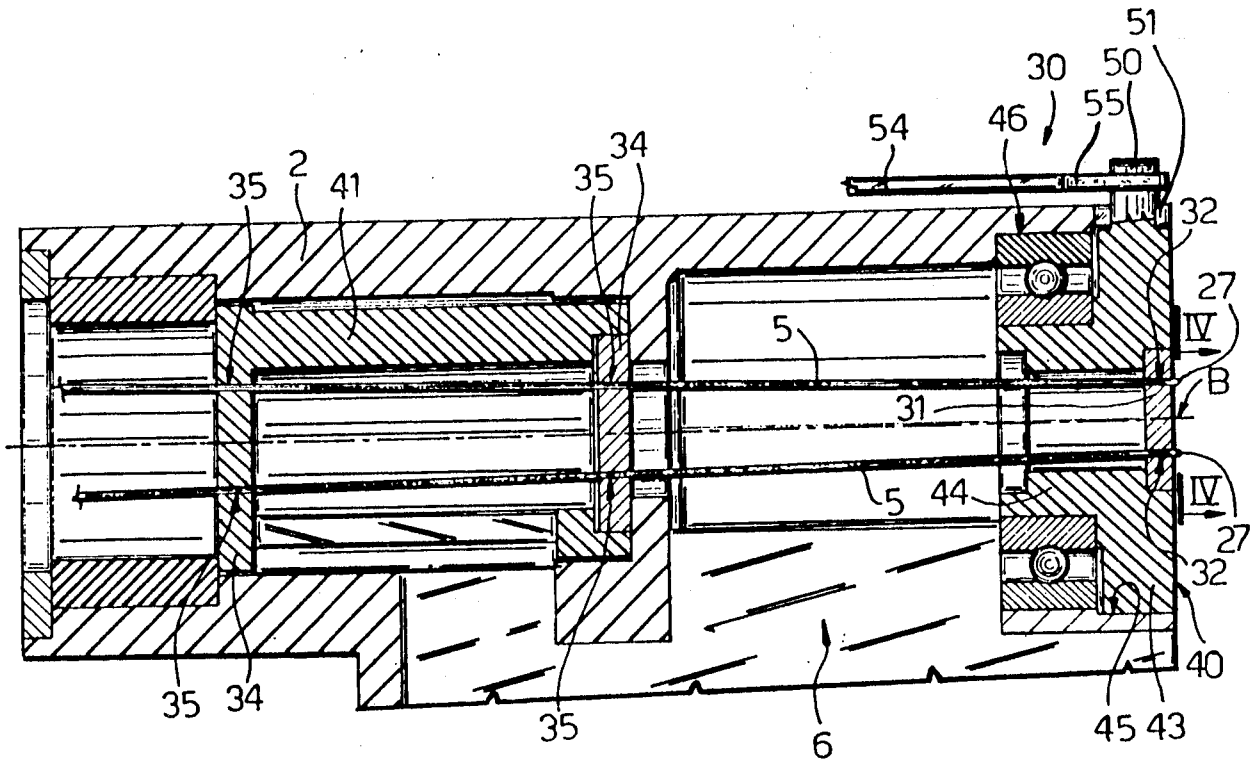
FIG. 2 shows a larger-scale section of a detail on the FIG. 1 head.
Figure 4:
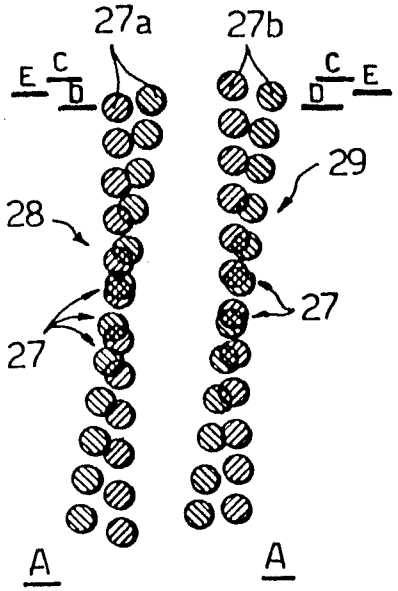
FIG. 4 shows a larger-scale schematic front section along line IV—IV of the pins on the printing head according to the present invention in two different operating positions.
Figure 3:
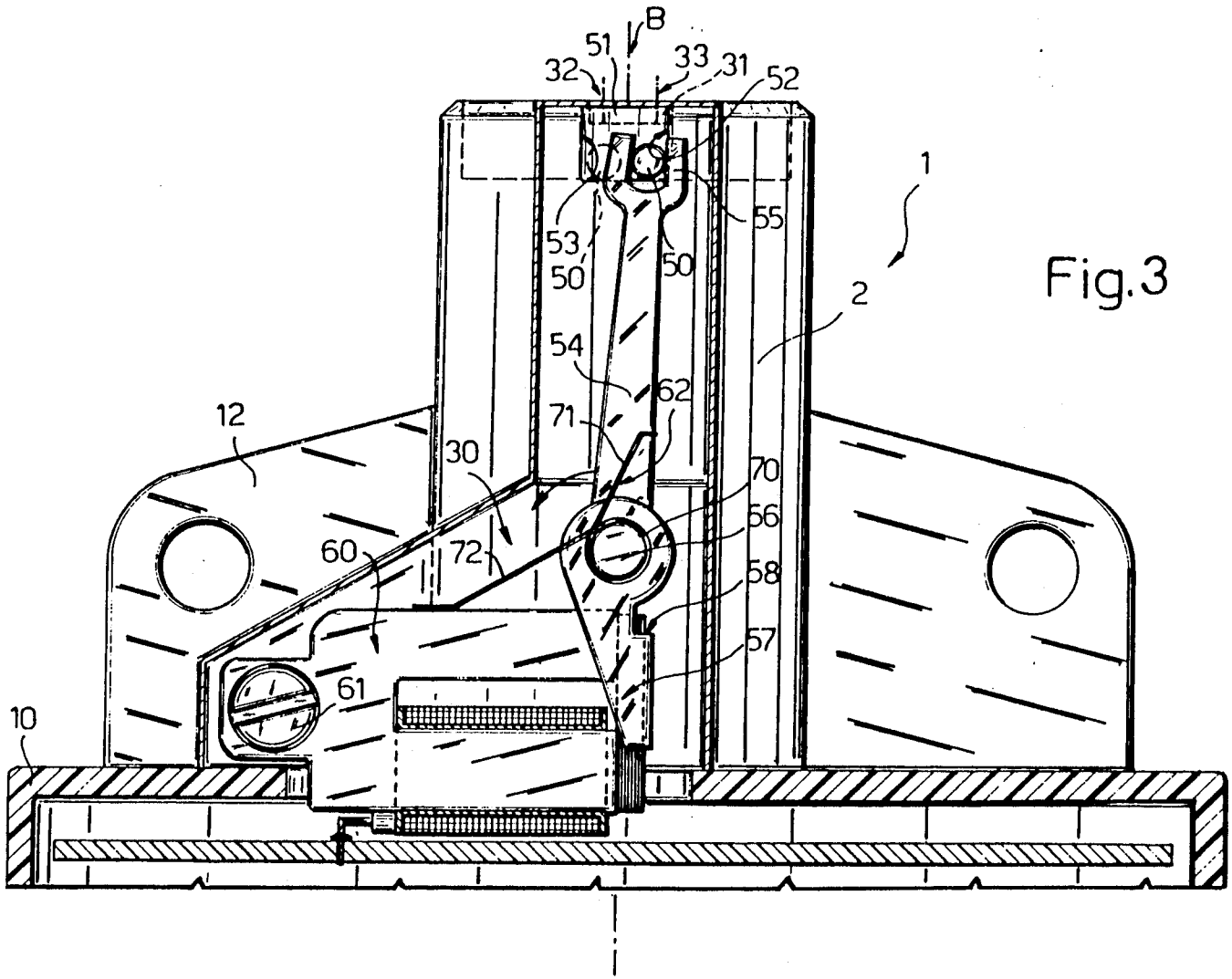
FIG. 3 shows a top plan view of the printing head according to the present invention.

Number 1 in FIGS. 1 to 4 indicates a dot matrix printing head comprising a supporting body 2 designed to travel in a printing plane parallel to that of FIG. 3 and indicated A—A in FIGS. 1 and 4; a number of rocking striker elements 4 (only one of which is shown) arranged radially in a ring about the longitudinal axis of symmetry B of supporting body 2 parallel to printing plane A—A; and a number of flexible steel printing pins 5 (e.g. 24) of which only a few are shown for the sake of simplicity. Said pins 5 are moved along axis B by guide means indicated as a whole by 6 (FIG. 2), and each present a root end 7 designed to cooperate with a first end 8 of a respective striker element 4, so as to be shifted selectively, against the action of elastic means, by the rocking action of the same. In particular, supporting body 2 is nose-shaped and secured integral with a casing 10 closed at opposite ends by body 2 and cap 11, and having a bottom mounting plate 12 for assembly to a known type of carriage or mechanism for moving head 1 parallel to the printing plane, and forming part of any known type of printer (not shown) to which head 1 is fitted. Striker elements 4 are carried on cap 11 and selectively controlled in known manner by means of a respective known type of U-shaped electromagnet 13. Electromagnets 13 are housed radially in a ring, in known manner, inside casing 10, and striker elements 4 pivot on end 14, opposite said end 8, by simply resting on respective poles 15 of electromagnets 13 against which they are held by respective known elastomeric rings 16 and 18 carried on cap 11 and which also provide by vibration damping. According to the present invention, each of striker elements 4 comprises an insert 19 formed from ferromagnetic material and embedded inside a synthetic plastic covering 20. Root ends 7 of pins 5 are also embedded inside covering 20 of respective striker element 4, so as to form a monolithic whole of pin 5 and striker element 4. By virtue of the aforementioned feature, said elastic means for restoring pins 5 to the idle position also provide for performing the same function in relation to striker elements 4 and, in the non-limiting example shown, consist of push rods 21 housed, in sliding and projecting manner against spring 22, inside respective seats 23 formed in a central annular element 24 integral with magnets 13, and each acting directly on a respective striker element 4 for preventing the same from rotating in the direction of the arrow (FIG. 1) towards respective electromagnet 13. According to the present invention, at the free end of body 2, opposite casing 10, said guide means 6 support respective tips 27 of pins 5, opposite root ends 7, in a first and second row 28,29 (FIG. 4) parallel to each other and each defined by a series of coplanar, equally-spaced tips 27. Tips 27 in row 28 present the same spacing as those in row 29, and are guided by means 6 in such a manner as to be located beside and offset in relation to the same, as shown clearly by the leftward hatching in FIG. 4. The different hatching in FIG. 4 indicates two possible operating positions of tips 27 in rows 28 and 29, as described in more detail later on. In conjunction with the above characteristic and the fact that root ends 7 are secured integral with respective striker elements 4, said guide means 6 are mounted in idle manner on supporting body 2, so as to turn about said axis B, and printing head 1 comprises means (indicated as a whole by 30) for selectively setting said guide means 6 to two different angular positions, in a first of which (leftward hatching in FIG. 4) rows 28 and 29 of tips 27 of pins 5 are arranged substantially perpendicular to printing plane A—A, and in a second of which (rightward hatching in FIG. 4) rows 28 and 29 are arranged obliquely in relation to the printing plane, and at such an angle that tips 27 of said first row 28 are arranged beside those of said second row 29 and in common planes parallel to said printing plane. In particular, said guide means 6 comprise a known type of matrix 31 formed from hard material and housing tips 27 in sliding manner inside two sets of axial through holes 32, 33 (only the axis of symmetry of which is shown in FIG. 3) parallel to axis B and formed in two parallel offset rows in the same way as tips 27 indicated by the leftward hatching in FIG. 4. Means 6 also comprise a pair of known guide elements 34 with holes 35 through which pins 5 slide. Said matrix 31 is fitted angularly integral with a bush 40 mounted inside supporting body 2, designed to turn freely about said axis B, and secured to said angular positioning means 30. Guide elements 34 are fitted angularly integral with respective opposite ends of a coupling 41 housed in idle manner inside body 2, coaxial with bush 40, and rotated by the same via pins 5 which, through holes 32, 33 and 35, angularly connect elements 34 to matrix 31.

Said bush 40 comprises a pair of cylindrical shoulders 43 and 44 of different diameters, and is supported inside an end seat 45 on body 2 via the interposition of a known rolling bearing 46 mounted on smaller-diameter cylindrical shoulder 44 facing the root ends of pins 5. Larger-diameter shoulder 43 closes said seat 45 outwards of body 2, and houses matrix 31.

According to the non-limiting example shown, said means 30 comprise a pin 50 projecting radially from bush 40 through a transverse slot 51 formed through supporting body 2, and a pivoted lever 54 engaging pin 50 and designed to selectively lock the same at opposite ends 52, 53 of slot 51. In particular, pin 50 is secured angularly integral with bush 40, by virtue of being formed in one piece with and projecting in relation to shoulder 43; and lever 54, which engages pin 50 via a forked end 55, is secured to supporting body 2 via a pivot 56, in such a manner as to turn parallel to printing plane A—A. Lever 54 is formed as a whole from plastic material, and presents a second end 57, opposite end 55, formed from ferromagnetic material and defined by a pack of ferromagnetic blades retained in projecting manner inside a recess 58 formed on lever 54. End 57 is located next to an electromagnet 60, e.g. of the same type as electromagnets 13, fitted transversely to the outside of body 2, e.g. by means of screw 61, and designed to attract end 57, against the action of a return spring 62 mounted on pin 56 of lever 54, and so set pin 50 against end 52 of slot 51 as shown in FIG. 3. According to the present invention, when pin 50 is so positioned, bush 40 is set to such an angle that tips 27 are retained in sliding manner by matrix 31 in the leftward-hatched position in FIG. 4, wherein top pin 5 in row 29 presents a tip 27*b* lying in plane C—C parallel to printing plane A—A and offset in relation to plane D—D in which lies tip 27*a* of the corresponding top pin 5 in row 28, and both rows 28 and 29 are substantially perpendicular to the printing plane of head 1. As such, tips 27 in row 28 are offset in relation to those of row 29, so that printing pins 5 provide for imprinting partially overlapping dots for high-definition (NLQ) printing.

Said spring 62 is omega-shaped, and presents an eyelet 70 engaging pin 56; an arm 71 secured to lever 54 on the end 55 side; and a return arm 72 resting on one side of electromagnet 60. When assembled, spring 62 is preloaded so as to draw arm 71 towards arm 72 (in the direction of the arrow in FIG. 3) and so normally maintain lever 54 (when electromagnet 60 is de-activated) in a position wherein pin 50 (dotted line in FIG. 3) is locked against end 53 of slot 51, which also acts as a limit stop for lever 54. When pin 50 is so positioned, bush 40 is set to such an angle that tips 27 are maintained in sliding manner by matrix 31 in the rightward-hatched position in FIG. 4, wherein top pin 5 in row 29 presents a tip 27*b* lying in plane E—E, which also contains tip 27*a* of top pin 5 in row 28. Moreover, both rows 28 and 29 are arranged obliquely in relation to the printing plane of head 1, and at such an angle that all the tips in row 29 are coplanar with those of row 28, said tips lying in a number of planes parallel to the printing plane and plane E—E, and with the same spacing as holes 32 guiding pins 5 in each row. Pins 5 are thus arranged side by side for enabling high-speed printing, with the dots forming each character maintained separate. Operation of printing head 1 according to the present invention will be obvious from the foregoing description. Under normal operating conditions with electromagnet 60 de-activated, matrix 31 and guide elements 34 (connected angularly to matrix 31 via pins 5) are so positioned by spring 62 as to position tips 27 in two oblique rows in relation to printing plane A—A, as shown in FIG. 4. By virtue of featuring two sets of side by side pins, head 1, when set to a given position, is thus able to print twice the number of dots as compared with a standard head with only one row of pins, thus providing for extremely high-speed printing. At any time, even while it is moving, head 1 may be switched from high-speed to high-definition (NLQ) printing, wherein the dots forming the characters are overlapped, by simply activating electromagnet 60. When activated, electromagnet 60 attracts the ferromagnet blades on end 57, so as to turn lever 54, against the action of spring 62, into the FIG. 3 position in which it is maintained as long as electromagnet 60 is activated. This provides for turning matrix 31 and guide elements 34 by a sufficient amount to set tips 27 into two rows perpendicular to the printing plane of head 1, as shown in FIG. 4. By virtue of pins 5 being arranged in two offset rows, the spaces between the dots imprinted by one row of pins 5 may be filled with those of the other row for printing practically continuous characters. Consequently, printing speed, even in NLQ mode, is at least twice that of a standard head featuring one row of pins, plus the fact that pin shifting in relation to the sheet for filling in the draft mode characters is no longer required. As compared with known printing heads featuring two adjustable rows of pins, the head according to the present invention provides for greater strength, straightforward design, and a high degree of dependability. Finally, by virtue of eliminating rotation of the entire printing head, the present invention enables the production of printers providing not only for switching from one printing mode to another while the head is moving, but also for reducing energy consumption.

I claim:

1. A dot matrix printing head comprising a supporting body designed to travel in a printing plane; a number of rocker striker elements arranged radially about a longitudinal axis of symmetry of said supporting body parallel to said printing plane, electromagnetic activating means associated with each said striker element; a plurality of flexible printing pins adapted for linear movement relative to the longitudinal axis, each printing pin having a root end and a tip end, the root end of each printing pin designed to cooperate with a first end of a respective striker element; elastic means cooperatively associated with said root end; the electromagnetic activating means serving to activate a respective striker element so as to selectively shift one of said printing pins against the action of the elastic means by the rocking action of the same; a rotatable guide means designed to support the tips of said flexible pins, opposite said root ends, the guide means designed to define a first row and a second row of flexible pins in parallel alignment to each other; each said row being defined by a series of equally-spaced coplanar tips, the tips in said first row presenting the same spacing and being located beside and offset in relation to those of said second row; means for selectively rotatably positioning said guide means relative to the supporting body through two different angular positions, in a first of which said rows of tips are arranged substantially perpendicular to said printing plane, and in a second of which said rows of tips are arranged obliquely in relation to said printing plane, and at such an angle that the tips in said first row are located beside those of said second row and in common planes parallel to the printing plane; characterized by the fact that said root ends of said pins are secured integral with said first ends of said striker elements; and by the fact that said guide means comprise a matrix, the matrix having two sets of through holes for receiving and supporting said tips of said pins in sliding manner; and at least a pair of guide elements having holes through which said pins slide; a bush rotatably mounted on said supporting body and designed to turn freely about said axis, the matrix being secured angularly integral with said bush and designed to rotate therewith relative to said axis, and said matrix being operatively connected to said positioning means; a coupling housed in idle manner inside said supporting body coaxial with said bush and having opposite ends, said guide elements being secured angularly integral with respective opposite ends of said coupling, and turned by the same via said pins.

2. A printing head as claimed in claim 1, characterized by the fact that said bush supporting said matrix comprises a pair of cylindrical shoulders of different diameters, the supporting body having a seat to receive said shoulders; a rolling bearing mounted on the smaller-diameter cylindrical shoulder, said rolling bearing facing said root ends of said pins and cooperating with said seat to rotatably support the pair of cylindrical shoulders, said seat being closed outwards of said supporting body by the larger-diameter cylindrical shoulder housing said matrix.

3. A printing head as claimed in claim 1, characterized by the fact that said positioning means comprise a pin projecting radially from said bush and secured angularly integral with said bush; a transverse slot formed through said supporting body through which the positioning means pin extends, the slot having first and second opposite ends parallel to the longitudinal axis of said supporting body; and lever means engaging the positioning means pin and fitted to the outside of said supporting body; said lever means being designed to selectively lock said pin between the opposite ends of said slot.

4. A printing head as claimed in claim 3, characterized by the fact that the lever includes a forked end designed to engage the positioning means pin in such a manner as to turn parallel with said printing plane, and a second end, opposite said forked end, formed from ferromagnetic material; said positioning means also comprising a preloaded spring designed to normally maintain said lever in such a position as to lock said positioning means pin against a first end of said slot, wherein said bush is positioned with said matrix in said second position; and an electromagnet positioned to attract said second end of said lever, against the action of said spring, so as to lock said positioning means pin against a second end of said slot, opposite said first end, and so position said bush with said matrix in said first position.

5. A printing head as claimed in claim 1, characterized by the fact that each of said striker elements comprise a ferromagnetic insert and a synthetic plastic covering enclosing said ferromagnetic insert; said root ends of said pins also being embedded inside the covering of a respective said striker element, so that said pins form one piece with respect to said striker elements.

* * * * *